US012478123B2

(12) United States Patent
Kavisekara et al.

(10) Patent No.: US 12,478,123 B2
(45) Date of Patent: Nov. 25, 2025

(54) ADHERENT FASTENING PRODUCT AND MANUFACTURE THEREOF

(71) Applicant: Prym Intimates Group Limited, Kowloon (HK)

(72) Inventors: Heenatikumbure Kavisekara Mudiyanselage Anjana Piushan Kavisekara, Kandy (LK); Jayasuriya Arachchige Palitha Dhanushka Jayasuriya, Kadawatha (LK); Hapuarachchige Don Rasun Sajeewa, Wanaluwava (LK)

(73) Assignee: Prym Intimates Group Limited, Kowloon (HK)

( * ) Notice: Subject to any disclaimer, the term of this patent is extended or adjusted under 35 U.S.C. 154(b) by 641 days.

(21) Appl. No.: 17/603,303

(22) PCT Filed: Apr. 6, 2020

(86) PCT No.: PCT/SG2020/050212
§ 371 (c)(1),
(2) Date: Oct. 12, 2021

(87) PCT Pub. No.: WO2020/209795
PCT Pub. Date: Oct. 15, 2020

(65) Prior Publication Data

US 2022/0192299 A1 Jun. 23, 2022

(30) Foreign Application Priority Data

Apr. 12, 2019 (GB) ..... 1905187

(51) Int. Cl.
*A41F 1/00* (2006.01)
*A44B 13/00* (2006.01)

(52) U.S. Cl.
CPC ..... *A41F 1/006* (2013.01); *A44B 13/0029* (2013.01); *A44B 13/0052* (2013.01)

(58) Field of Classification Search
CPC .. A41F 1/006; A44B 13/0029; A44B 13/0052
See application file for complete search history.

(56) References Cited

U.S. PATENT DOCUMENTS 3,528,140 A 9/1970 Waldes
4,165,555 A 8/1979 Boxer
(Continued)

FOREIGN PATENT DOCUMENTS

CA 2666114 A1 12/2009
CN 1407862 A 4/2003
(Continued)

OTHER PUBLICATIONS

Translation of WO 2014174332 A1, Prym Intimates Group Ltd, Oct. 30, 2014 (Year: 2014).*
(Continued)

*Primary Examiner* — George R Koch
(74) *Attorney, Agent, or Firm* — Osha Bergman Watanabe & Burton LLP

(57) ABSTRACT

The present disclosure describes an adherent fastening product (100) for a garment, comprising: a substrate portion (110) having a first side (112) and a reverse second side (114); an adhesive layer portion (122, 124) disposed on the first side (112) and/or second side (114) of the substrate portion (110), the adhesive layer portion (122, 124) in an inactive state that inhibits adhesion thereof; and an array of fasteners (130) attached to the first side (112) of the substrate portion, wherein the adhesive layer portion (122, 124) is activatable to an active state that enables adhesion of the adherent fastening product (100) to the garment.

18 Claims, 8 Drawing Sheets

(56) References Cited

U.S. PATENT DOCUMENTS

| | | | | |
|---|---|---|---|---|
| 5,985,406 | A | 11/1999 | Takizawa et al. | |
| 6,571,432 | B1 | 6/2003 | Rindle | |
| 7,722,433 | B2 | 5/2010 | Utaka | |
| 8,359,718 | B2 | 1/2013 | Yeung | |
| 9,321,218 | B2 | 4/2016 | Han | |
| 9,700,081 | B2 | 7/2017 | Tempesta | |
| 9,700,082 | B2 | 7/2017 | Tempesta | |
| 9,918,500 | B2 | 3/2018 | Tempesta | |
| 9,961,945 | B2 | 5/2018 | Tempesta | |
| 2002/0106970 | A1 | 8/2002 | Falla | |
| 2009/0223029 | A1* | 9/2009 | Leung | A41F 1/006 83/13 |
| 2010/0132412 | A1 | 6/2010 | Baldauf et al. | |
| 2013/0199005 | A1 | 8/2013 | Fung | |
| 2015/0101106 | A1 | 4/2015 | Anderson | |
| 2015/0211236 | A1 | 7/2015 | Bowden | |
| 2016/0286868 | A1 | 10/2016 | Cardaci | |
| 2016/0366964 | A1 | 12/2016 | Eddey et al. | |
| 2017/0332718 | A1 | 11/2017 | Eyal | |
| 2018/0092439 | A1 | 4/2018 | Fildan et al. | |
| 2019/0357636 | A1* | 11/2019 | Utaka | A41F 1/002 |

FOREIGN PATENT DOCUMENTS

| | | | | |
|---|---|---|---|---|
| CN | 101621941 | A | 1/2010 | |
| CN | 202800243 | U | 3/2013 | |
| CN | 302538191 | S | 8/2013 | |
| CN | 104661552 | A | 5/2015 | |
| CN | 105604288 | A | 5/2016 | |
| CN | 107920943 | A | 4/2018 | |
| DE | 20118165 | U1 | 2/2002 | |
| EP | 0319249 | A1 | 6/1989 | |
| EP | 0809952 | A2 | 12/1997 | |
| EP | 0832573 | A1 | 4/1998 | |
| EP | 1839508 | A1 | 10/2007 | |
| GB | 941808 | A | 11/1963 | |
| GB | 2407476 | A | 5/2005 | |
| JP | 09313218 | A | 12/1997 | |
| JP | 3105465 | U | 9/2004 | |
| JP | 2006200084 | A | 8/2006 | |
| JP | 2015202165 | A | 11/2015 | |
| WO | 9851850 | A1 | 11/1998 | |
| WO | 9949750 | A1 | 10/1999 | |
| WO | 2001041596 | A2 | 6/2001 | |
| WO | 2008093443 | A1 | 8/2008 | |
| WO | WO-2010129244 | A2 * | 11/2010 | A44B 18/0023 |
| WO | 2014174332 | A1 | 10/2014 | |
| WO | 2017140514 | A1 | 8/2017 | |

OTHER PUBLICATIONS

International Search Report issued in International Application No. PCT/SB2020/050212 dated Jun. 29, 2020 (4 pages).

Written Opinion issued in International Application No. PCT/SB2020/050212 dated Jun. 29, 2020 (5 pages).

Examination Report issued in United Kingdom Application No. 1905187.9, mailed on May 26, 2021 (4 pages).

Examination Report issued in United Kingdom Application No. 1905187.9, mailed on Oct. 20, 2021 (3 pages).

United Kingdom Search Report issued in United Kingdom Application No. 1905187.9, mailed on Oct. 7, 2019 (4 pages).

Office Action issued in counterpart Japanese Patent Application No. 2021-560699 mailed on Oct. 3, 2023 (8 pages).

Office Action issued in counterpart Chinese Patent Application No. 202080042285.9 mailed on Dec. 6, 2023 (14 pages).

Office Action issued in counterpart Japanese Patent Application No. 2024-119282 mailed on Jan. 21, 2025 (6 pages).

* cited by examiner

ADHERENT FASTENING PRODUCT AND MANUFACTURE THEREOF

This application is a 371 of PCT/SG2020/050212, filing date Apr. 6, 2020.

TECHNICAL FIELD

The present disclosure generally relates to an adherent fastening product and manufacture thereof. More particularly, the present disclosure describes various embodiments of an adherent fastening product for a garment, as well as a method of manufacturing such adherent fastening products for garments.

BACKGROUND

Various types of garments, particularly intimate garments such as brassieres, lingerie, sportswear, and similar close-fitting or form-fitting garments, have components which are used to fasten the garments when wearing and similarly to unfasten the garments when removing. One type of such fastening components or products is the hook-and-eye tape which can be used in intimate garments. United States patent publication US 20130199005 describes one example of the hook-and-eye tape. Conventionally, a hook-and-eye tape is made as a separate component from the garment for which the hook-and-eye tape is used for, and the hook-and-eye tape has provisions for stitching or bonding with the garment. The hook-and-eye tape is then attached or bonded to the garment subsequently during manufacturing the garment. For said bonding to happen, some surfaces of the hook-and-eye tape are coated or lined with a suitable adhesive, e.g. a glue substance, during manufacturing of the garment. Coating or lining of the hook-and-eye tape is a time-consuming operation during manufacturing of the garment.

Therefore, in order to address or alleviate at least the aforementioned problem or disadvantage, there is a need to provide an improved adherent fastening product for a garment as well as a method of manufacturing such adherent fastening products.

SUMMARY

According to a first aspect of the present disclosure, there is an adherent fastening product for a garment, comprising: a substrate portion having a first side and a reverse second side; an adhesive layer portion disposed on the first side and/or second side of the substrate portion, the adhesive layer portion in an inactive state that inhibits adhesion thereof; and an array of fasteners attached to the first side of the substrate portion, wherein the adhesive layer portion is activatable to an active state that enables adhesion of the adherent fastening product to the garment.

According to a second aspect of the present disclosure, there is a method of manufacturing adherent fastening products for garments. The method comprises forming a continuous batch of adherent fastening products, comprising: forming a substrate having a first side and a reverse second side; disposing an adhesive layer on the first side and/or second side of the substrate, the adhesive layer in an inactive state that inhibits adhesion thereof; and attaching fasteners to the first side of the substrate, wherein the adhesive layer is activatable to an active state that enables adhesion of the adherent fastening products to the garments.

An advantage of one or more of the above aspects of the present disclosure is that the adherent fastening product has an adhesive layer portion that is initially in the inactive state to support handling. The adhesive layer portion can then be activated to the active state for permanently adhering the adherent fastening product to the garment. The adhesive layer portion thus functions as a pre-applied glue film or web lining that obviates the need for the conventional time-consuming operation of coating or lining garment fastening products, such as the hook-and-eye tapes, during manufacturing of the garment.

An adherent fastening product for a garment and a method of manufacturing the adherent fastening products according to the present disclosure are thus disclosed herein. Various features, aspects, and advantages of the present disclosure will become more apparent from the following detailed description of the embodiments of the present disclosure, by way of non-limiting examples only, along with the accompanying drawings.

DETAILED DESCRIPTION

In the present disclosure, depiction of a given element or consideration or use of a particular element number in a particular figure or a reference thereto in corresponding descriptive material can encompass the same, an equivalent, or an analogous element or element number identified in another figure or descriptive material associated therewith. The use of "/" in a figure or associated text is understood to mean "and/or" unless otherwise indicated. As used herein, the term "set" corresponds to or is defined as a non-empty finite organization of elements that mathematically exhibits a cardinality of at least one (e.g. a set as defined herein can correspond to a unit, singlet, or single element set, or a multiple element set), in accordance with known mathematical definitions. The recitation of a particular numerical value or value range herein is understood to include or be a recitation of an approximate numerical value or value range.

For purposes of brevity and clarity, descriptions of embodiments of the present disclosure are directed to an adherent fastening product for a garment and a method of manufacturing the adherent fastening products, in accordance with the drawings. While aspects of the present disclosure will be described in conjunction with the embodiments provided herein, it will be understood that they are not intended to limit the present disclosure to these embodiments. On the contrary, the present disclosure is intended to cover alternatives, modifications and equivalents to the embodiments described herein, which are included within the scope of the present disclosure as defined by the appended claims. Furthermore, in the following detailed description, specific details are set forth in order to provide a thorough understanding of the present disclosure. However, it will be recognized by an individual having ordinary skill in the art, i.e. a skilled person, that the present disclosure may be practiced without specific details, and/or with multiple details arising from combinations of aspects of particular embodiments. In a number of instances, well-known systems, methods, procedures, and components have not been described in detail so as to not unnecessarily obscure aspects of the embodiments of the present disclosure.

Figure 1A:
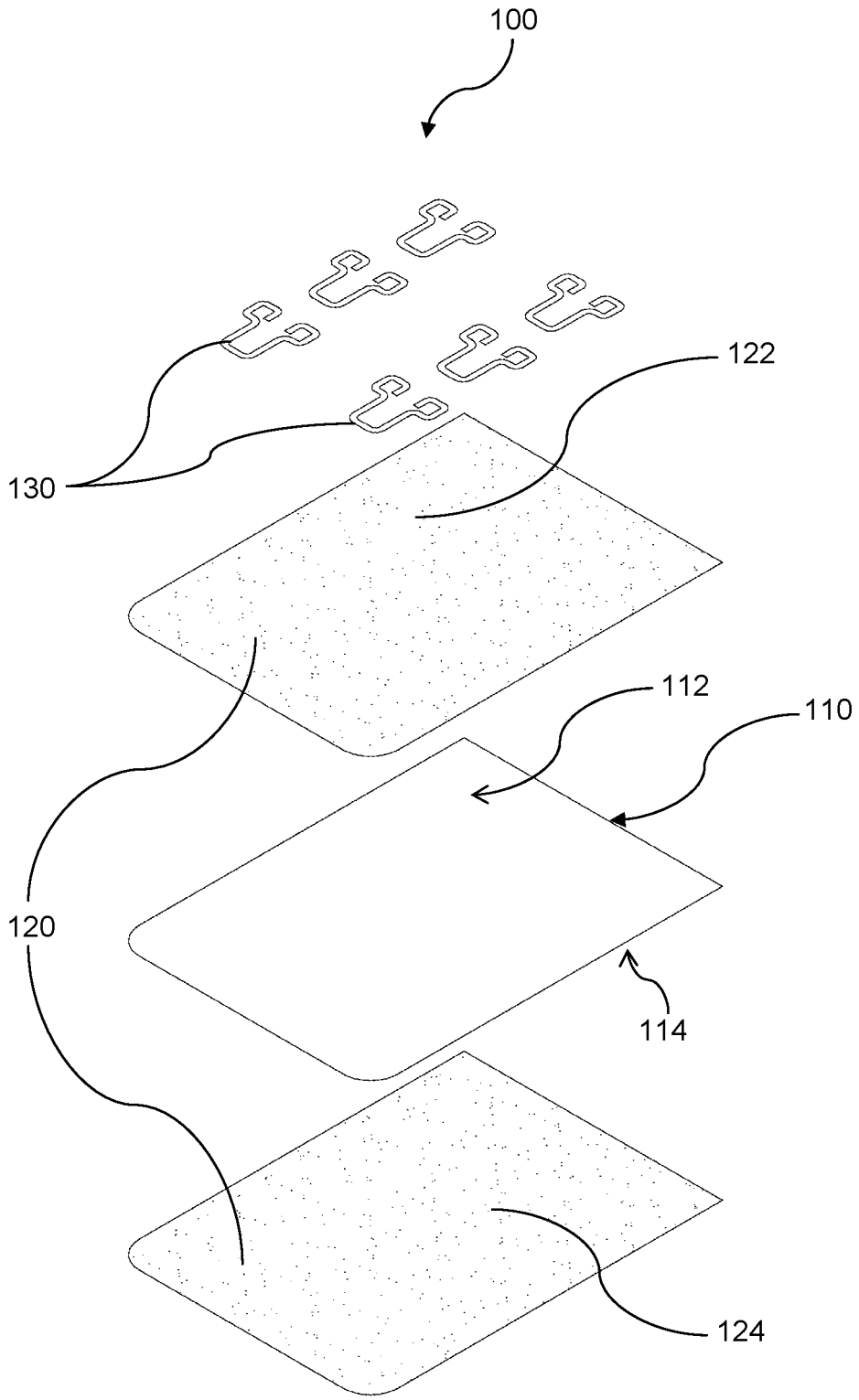
FIG. 1A is an illustration of an exploded view of an adherent fastening product, in accordance with embodiments of the present disclosure.

In representative or exemplary embodiments of the present disclosure, there is an adherent fastening product 100 for a garment (not shown) as illustrated in FIG. 1A. The garment may be an intimate garment or undergarment, such as but not limited to brassieres, lingerie, sportswear, and similar close-fitting or form-fitting garments. The adherent fastening product 100 includes a substrate portion 110 having a first side 112 and a reverse second side 114. The first side 112 and second side 114 may be the front side and rear side, respectively, of the substrate portion 110. The adherent fastening product 100 further includes an adhesive layer portion 120 disposed on the first side 112 and/or second side 114 of the substrate portion 110. The adherent fastening product 100 further includes an array of fasteners 130 attached to the first side 112 of the substrate portion 110.

The width of the adhesive layer portion 120 may be identical to the width of the substrate portion 110 to achieve optimum adhesion. In some embodiments, the adhesive layer portion 120 is disposed only on one of the first side 112 and second side 114 of the substrate portion 110. In some other embodiments, the adhesive layer portion 120 is disposed both of the first side 112 and second side 114 of the substrate portion 110. Specifically, the adhesive layer portion 120 includes a first adhesive layer portion 122 disposed on the first side 112 of the substrate portion 110, and includes a second adhesive layer portion 124 disposed on the second side 114 of the substrate portion 110. In one embodiment as shown in FIG. 1A, the first adhesive layer portion 122 and second adhesive layer portion 124 are discrete. In another embodiment, the first adhesive layer portion 122 and second adhesive layer portion 124 are continuous such that the adhesive layer portion 120 is disposed continuously around the substrate portion 110 on the first side 112 and second side 114 thereof.

The substrate portion 110 provides a firm structural base for attachment of the fasteners 130. The substrate portion 110 may include a fabric body formed from one or more layers of fabric material. Construction of the substrate portion 110, including selection of the fabric material and arrangement of the layers of fabric material, may be dependent on the requirements of end applications of the adherent fastening product 100 and the garment. These requirements may include parameters such as thickness and structural strength/integrity of the fabric material. The substrate portion 110 may alternatively include films and/or membranes instead of the fabric body. Yet alternatively, the substrate portion 110 may be formed from other suitable materials known to the skilled person.

In some embodiments, the adhesive layer portion 120 includes the first adhesive layer portion 122 disposed on the first side 112 of the substrate portion 110 such that the fasteners 130 are attached to the first side 112 of the substrate portion 110 through the first adhesive layer portion 122. In some embodiments, the fasteners 130 are stitched, such as by using conventional threads, yarns, and sewing methods, to the first side 112 of the substrate portion 110.

The array of fasteners 130 attached to the substrate portion 110 may be arranged in any number of rows and any number of columns. Particularly, the array of fasteners 130 includes at least one fastener 130. The fasteners 130 may be of the male type or female type, wherein the male and female fasteners 130 are mutually engageable. The male/female fasteners 130 may be formed from known fastening/coupling mechanisms, such as hooks and eyes, hook and loop tapes, snap-fit fasteners, eyelets, snap buttons, and the like. The choice of the fasteners 130 may be dependent on the end applications of the adherent fastening product 100 and the garment.

Figure 1B:
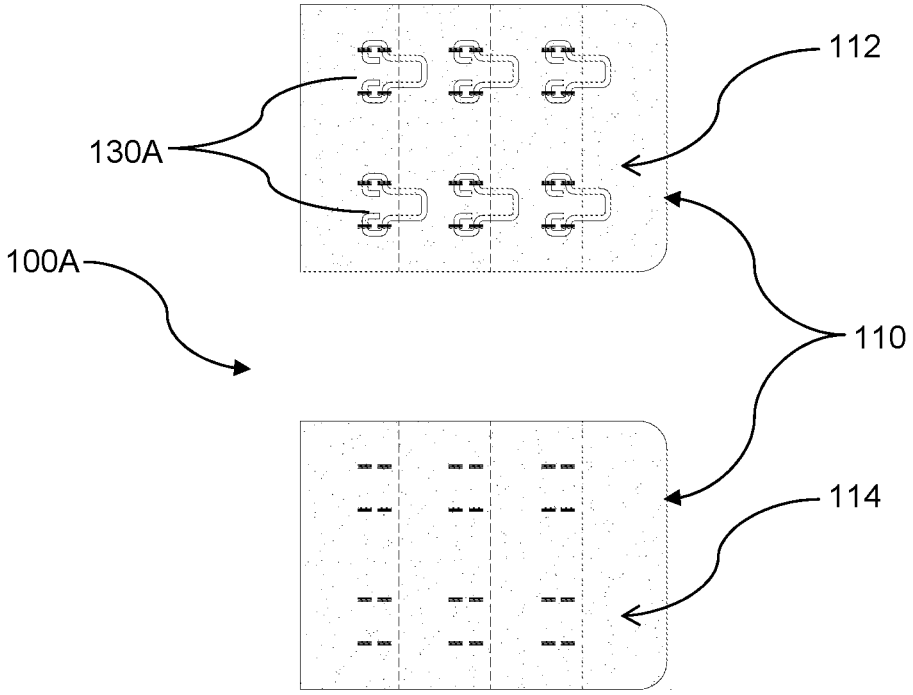
FIG. 1B is an illustration of both sides of a female adherent fastening product, in accordance with embodiments of the present disclosure.
Figure 1C:
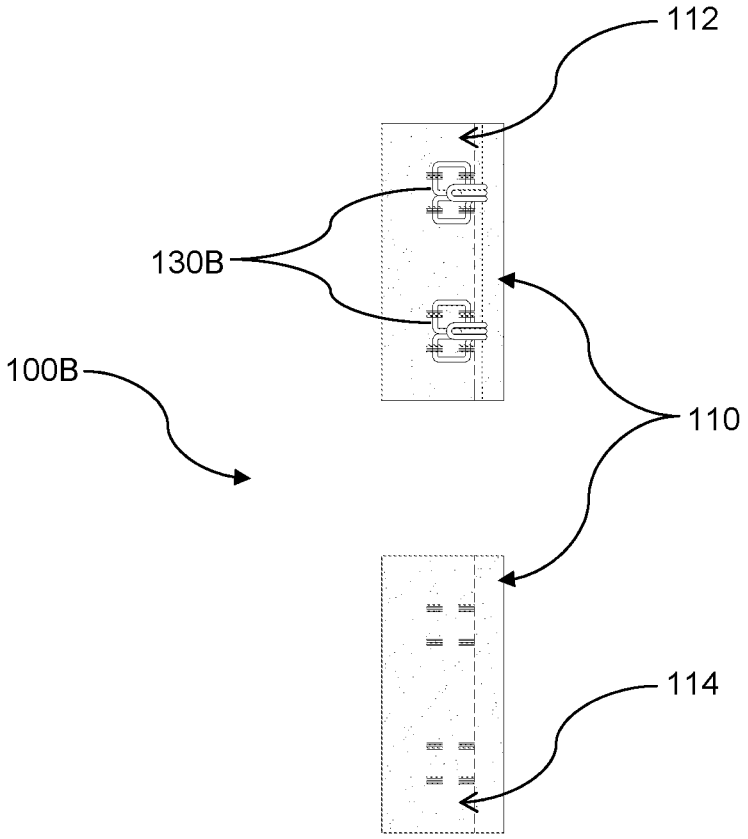
FIG. 1C is an illustration of both sides of a male adherent fastening product, in accordance with embodiments of the present disclosure.

A pair of the adherent fastening products 100 may be used for a garment, specifically to add a fastening function to the garment. The pair of adherent fastening products 100 consist of a female counterpart or female adherent fastening product 100A (as shown in FIG. 1B) and a male counterpart or male adherent fastening product 100B (as shown in FIG. 1C). The female adherent fastening product 100A includes an array of female fasteners 130A, and the male adherent fastening product 100B includes an array of male fasteners 130B. The female adherent fastening product 100A and male adherent fastening product 100B are mutually engageable via the female fasteners 130A and male fasteners 130B. When used in the garment, the female adherent fastening product 100A and male adherent fastening product 1008 may be attached or bonded to opposing sides of the garment, wherein they are mutually engageable for fastening and coupling (or conversely unfastening and decoupling) the opposing sides of the garment together.

In many embodiments, the adhesive layer portion 120 disposed on the first side 112/second side 114 of the substrate portion 110 is in an inactive state that inhibits adhesion thereof. Specifically, the inactive state of the adhesive layer portion 120 inhibits or restricts adhesion of the adhesive layer portion 120 to other surfaces so that the adherent fastening product 100 can be more easily handled by a user or machine. In some embodiments, the adhesive layer portion 120 in the inactive state is in the form of a film or web lining. The adhesive layer portion 120 in the inactive state may include a liquid glue substance in dry liquid form, e.g. dry powder.

The adhesive layer portion 120 is activatable from the inactive state to the active state that enables adhesion of the adherent fastening product 100 to the garment. In the inactive state, the adhesive layer portion 120 should be dry and attached to the substrate portion 110 firmly. This facilitates the manufacturing operation of inserting the adherent fastening product 100 in between layers of fabric of the garment manually or by a machine, thus reducing risk of contamination and/or damage. Also, the adhesive layer portion 120 should be applied evenly on the respective sides 112/114 of the substrate portion 110 in order to prevent or reduce bonding problems. In one embodiment, the activation may be achieved by subjecting the adhesive layer portion 120 to heating under various conditions including temperature, pressure, and duration. In another embodiment, the activation may be achieved by adding another substance to the adhesive layer portion 120 to trigger a chemical reaction that activates the adhesive layer portion 120 to the active state, thus enabling the adhesive layer portion 120 for adhesion to the garment or other surfaces. Further, various types of adhesives require various environmental conditions to be maintained to achieve the required bonding strength. Such conditions include holding time, holding temperature, holding pressure, humidity, etc.

As a non-limiting example, the liquid glue substance is applied to the first side 112/second side 114 of the substrate portion 110 to form the adhesive layer portion 120. The liquid glue substance is in the inactive state or dry liquid form during said application. The liquid glue substance may be applied in the form of a film or web lining and by means such as glue spraying. The liquid glue substance may be uncured or partially cured, such as by heating. Partially curing the liquid glue substance may enable the adhesive layer portion 120 to achieve some or limited adherence which would be useful for aligning and lightly adhering the adherent fastening product 100 to the garment. After aligning, the adhesive layer portion 120 can be activated to the active state and completely cured to achieve permanent adhesion to the garment.

Figure 2:
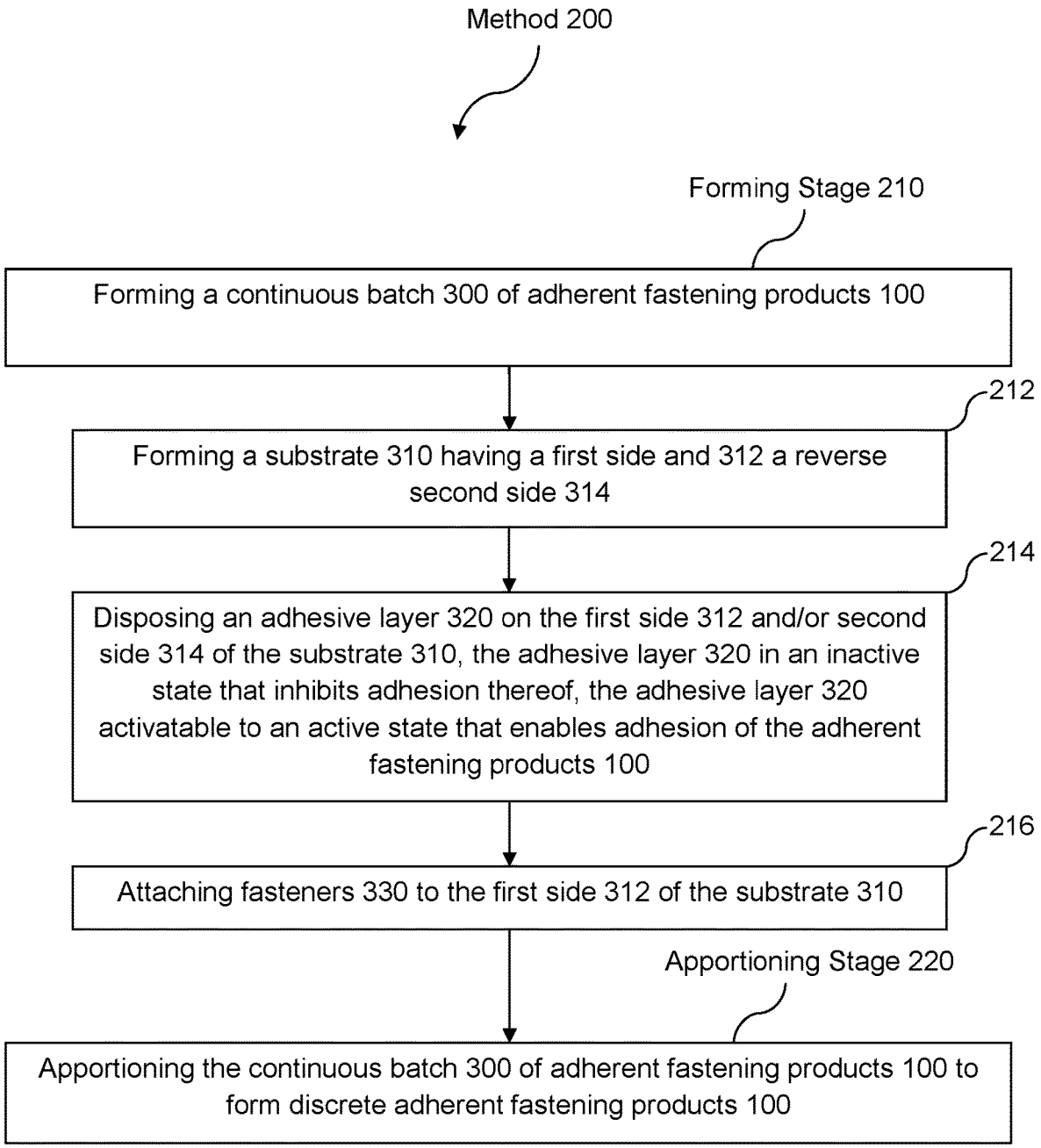
FIG. 2 is a flowchart illustration of a method of manufacturing the adherent fastening products, in accordance with embodiments of the present disclosure.
Figure 3A:
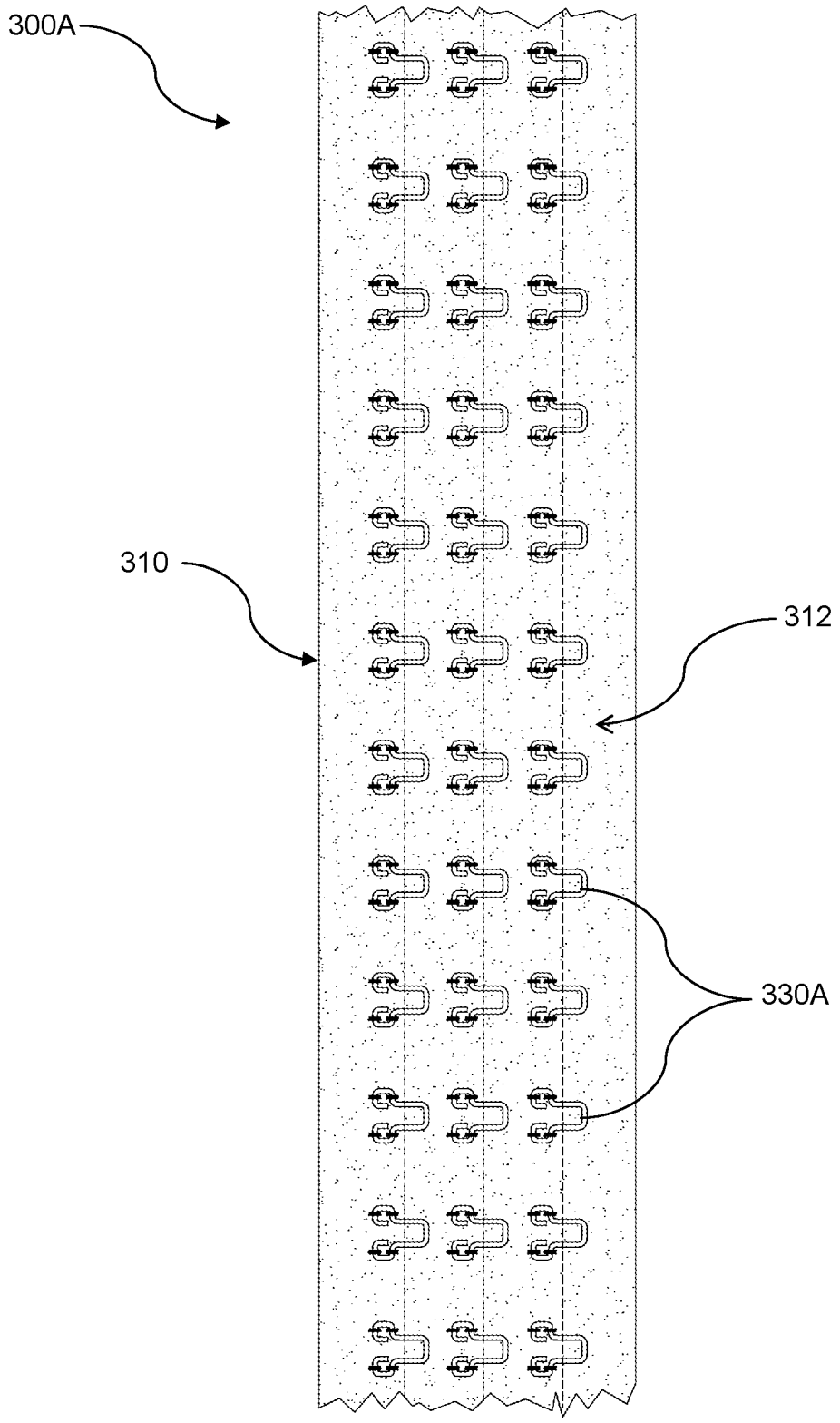
FIG. 3A is an illustration of a top view of a continuous female batch of female adherent fastening products, in accordance with embodiments of the present disclosure.
Figure 3B:
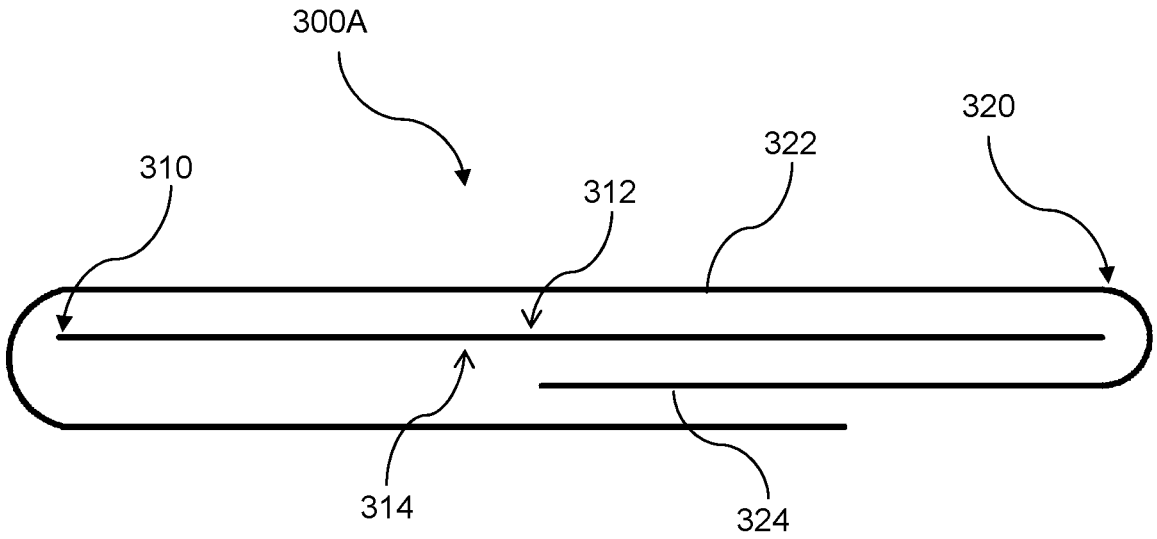
FIG. 3B is an illustration of a cross-sectional view of the continuous female batch of female adherent fastening products, in accordance with embodiments of the present disclosure.
Figure 3C:
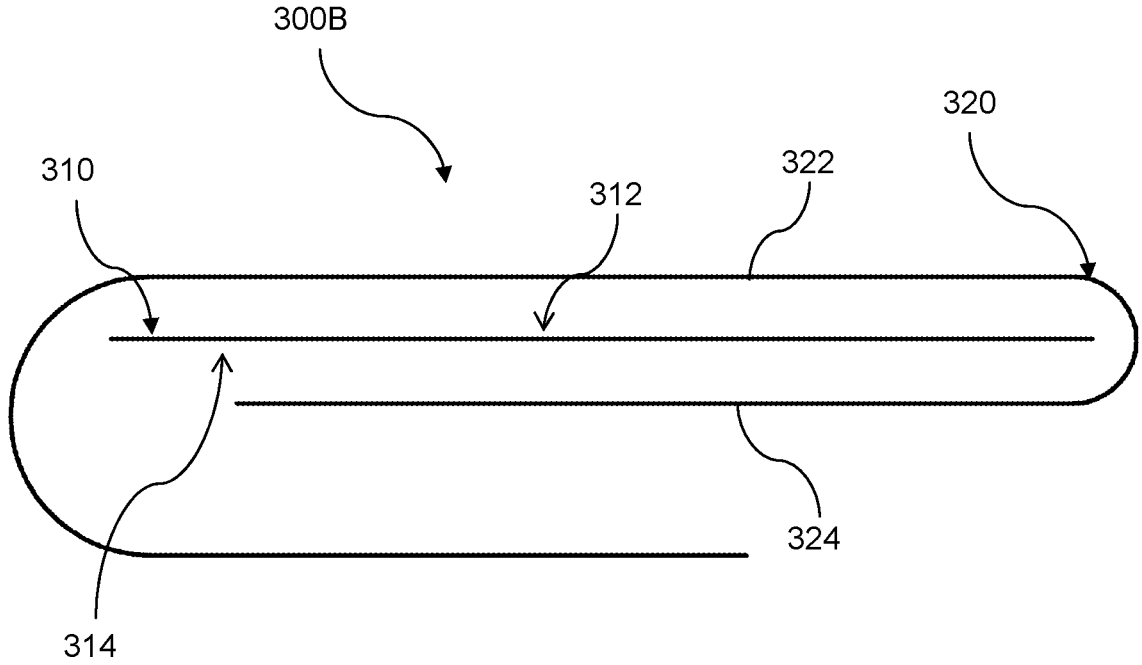
FIG. 3C is an illustration of a cross-sectional view of a continuous male batch of male adherent fastening products, in accordance with embodiments of the present disclosure.
Figure 3D:
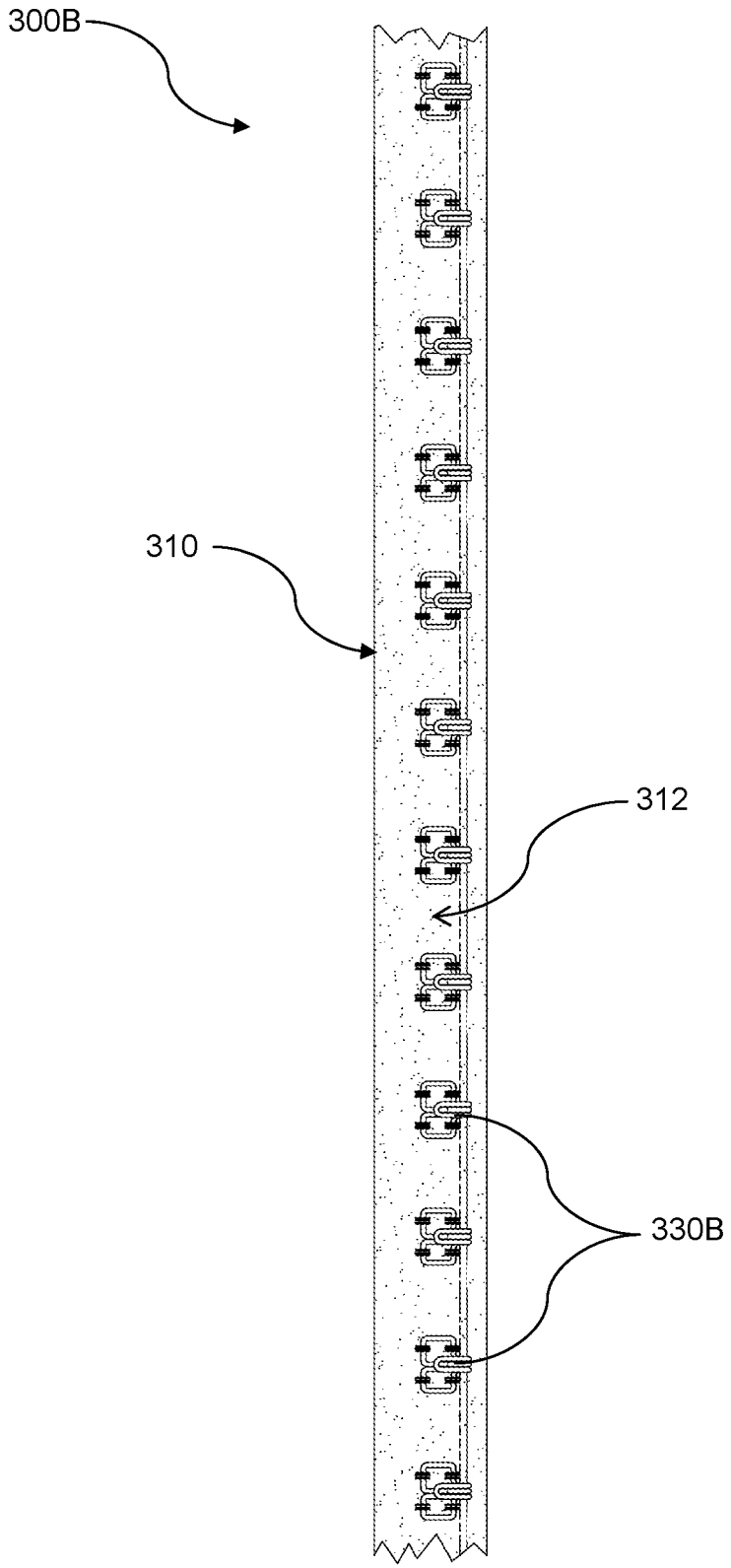
FIG. 3D is an illustration of a top view of the continuous male batch of male adherent fastening products, in accordance with embodiments of the present disclosure.

In various embodiments of the present disclosure, with reference to FIG. 2, there is a method 200 of manufacturing the adherent fastening products 100 for garments. The method 200 includes a forming stage 210 of forming a continuous batch 300 of the adherent fastening products 100. FIG. 3A and FIG. 3B illustrates a top view and a cross-sectional view of a continuous female batch 300A of the female adherent fastening products 100A. FIG. 3C and FIG. 3D illustrates a top view and a cross-sectional view of a continuous male batch 300B of the male adherent fastening products 100B.

The forming stage 210 includes a step 212 of forming a substrate 310 having a first side and 312 a reverse second side 314. The forming stage 210 further includes a step 214 of disposing an adhesive layer 320 on the first side 312 and/or second side 314 of the substrate 310, the adhesive layer 320 in an inactive state that inhibits adhesion thereof. The forming stage 210 further includes a step 216 of attaching fasteners 330 to the first side 312 of the substrate 310. Specifically, for the continuous female batch 300A, female fasteners 330A are attached to the first side 312 of the substrate 310. Similarly, for the continuous male batch 300B, male fasteners 330B are attached to the first side 312 of the substrate 310. The adhesive layer 320 is activatable to an active state that enables adhesion of the adherent fastening products 100 to the garments.

The width of the adhesive layer 320 may be identical to the width of the substrate 310 to achieve optimum adhesion for adherent fastening products 100. In some embodiments, the adhesive layer 320 is disposed only on one of the first side 312 and second side 314 of the substrate 310. In some other embodiments, the adhesive layer portion 320 is disposed both of the first side 312 and second side 314 of the substrate 310. Specifically, the adhesive layer 320 includes a first adhesive layer 322 disposed on the first side 312 of the substrate 310, and includes a second adhesive layer 324 disposed on the second side 314 of the substrate 310. In one embodiment as shown in FIG. 3B and FIG. 3C, said disposing of the adhesive layer 320 includes disposing the adhesive layer 320 continuously around the substrate 310 on the first side 312 and second side 314 of the substrate 310. In another embodiment, said disposing of the adhesive layer 320 includes disposing a discrete first adhesive layer 322 on the first side 312 of the substrate 310 and includes disposing a discrete second adhesive layer 324 on the second side 314 of the substrate 310.

The substrate 310 provides a firm structural base for attachment of the fasteners 330. The substrate 310 may include a fabric body formed from one or more layers of fabric material. Construction of the substrate 310, including selection of the fabric material and arrangement of the layers of fabric material, may be dependent on the requirements of end applications of the adherent fastening products 100 and the garments. These requirements may include parameters such as thickness and structural strength/integrity of the fabric material. The substrate 310 may alternatively include films and/or membranes instead of the fabric body. Yet alternatively, the substrate 310 may be formed from other suitable materials known to the skilled person.

In some embodiments, the adhesive layer 320 includes the first adhesive layer 322 disposed on the first side 312 of the substrate 310 such that the fasteners 330 are attached to the first side 312 of the substrate 310 through the first adhesive layer portion 322. In some embodiments, said attaching of the fasteners 330 includes stitching, such as by using conventional threads, yarns, and sewing methods, the fasteners 330 to the first side 312 of the substrate 310. It will be appreciated that said stitching may be performed by a programmable pattern stitching machine or an embroidery machine for high precision.

The fasteners 330 attached to the substrate 310 may be arranged in any number of rows and any number of columns. Particularly, the fasteners 330 includes at least one fastener 330. The fasteners 330 may be of the male type or female type, wherein the male and female fasteners 330 are mutually engageable. For example, the continuous female batch 300A includes female fasteners 330A and the continuous male batch 300B includes male fasteners 330B.

In many embodiments, the adhesive layer 320 disposed on the first side 312/second side 314 of the substrate 310 is in the inactive state that inhibits or restricts adhesion of the adhesive layer 320 to other surfaces so that the continuous batch 300 can be more easily handled by a user or machine. In some embodiments, the adhesive layer 320 in the inactive state is in the form of a film or web lining. The adhesive layer 320 in the inactive state may include a liquid glue substance in dry liquid form, e.g. dry powder.

Said disposing of the adhesive layer 320 may include applying a liquid glue substance in dry liquid form to the first side 312/second side 314 of the substrate 310. The liquid glue substance is in the inactive state or dry liquid form during said applying. The liquid glue substance may be applied in the form of a film or web lining and by means such as glue spraying. In one embodiment, the liquid glue substance is uncured. In another embodiment, said disposing of the adhesive layer 320 further includes partially curing the liquid glue substance, such as by heating.

Some steps in the forming stage 210 may be rearranged. In some embodiments, in the steps 214 and 216, the adhesive layer 320, i.e. the first adhesive layer 322, is disposed on the first side 312 of the substrate 310 first. The fasteners 330 are then attached to the first side 312 of the substrate 310 through the first adhesive layer 322. In some other embodiments, the fasteners 330 may be attached to the first side 312 of the substrate 310 first. The first adhesive layer 322 is then disposed on the first side 312 of the substrate 310, specifically on some or all of the exposed areas of the first side 312 that are not covered by the fasteners 330.

Figure 4A:
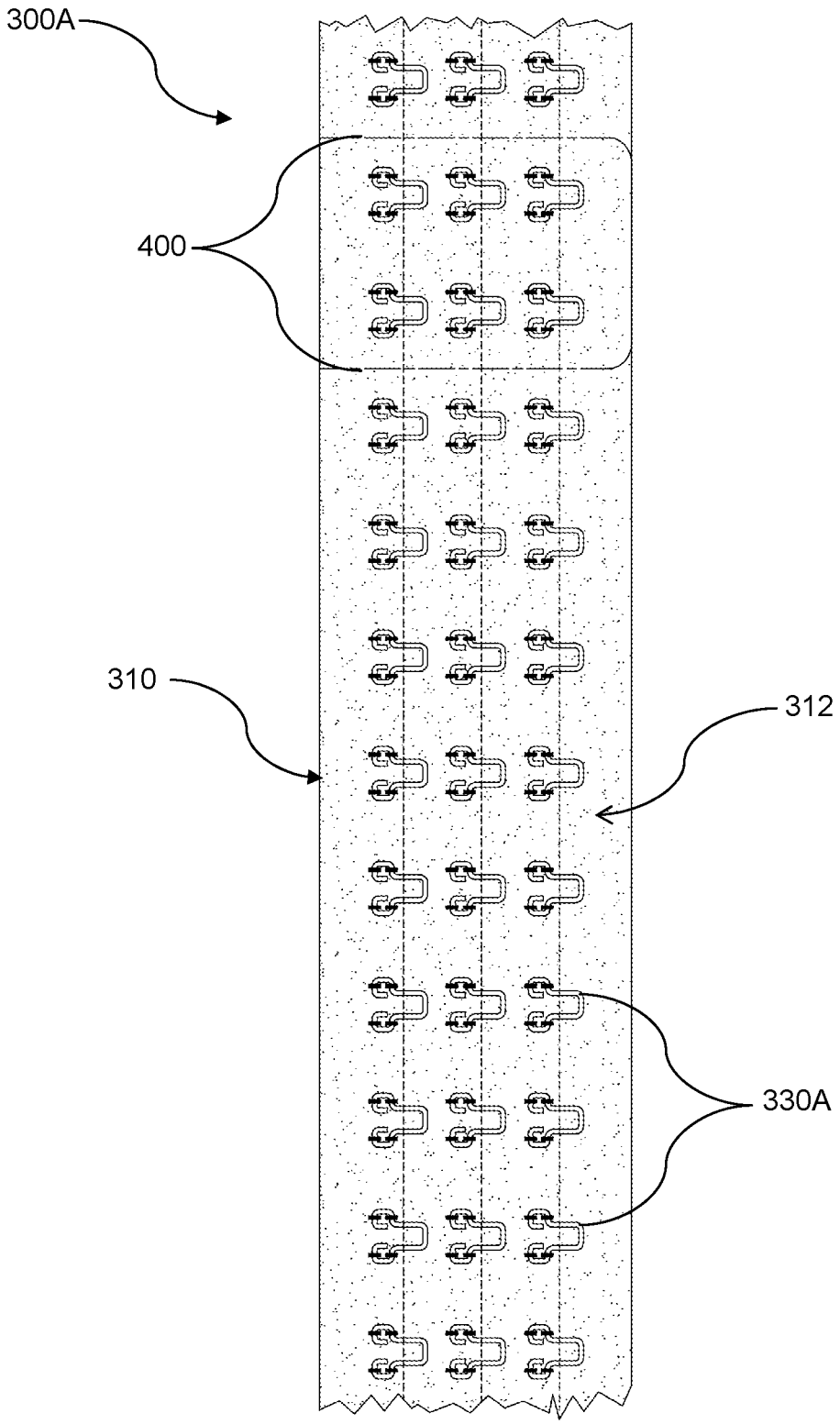
FIG. 4A is an illustration of a top view of the continuous female batch for apportioning into discrete female adherent fastening products, in accordance with embodiments of the present disclosure.
Figure 4B:
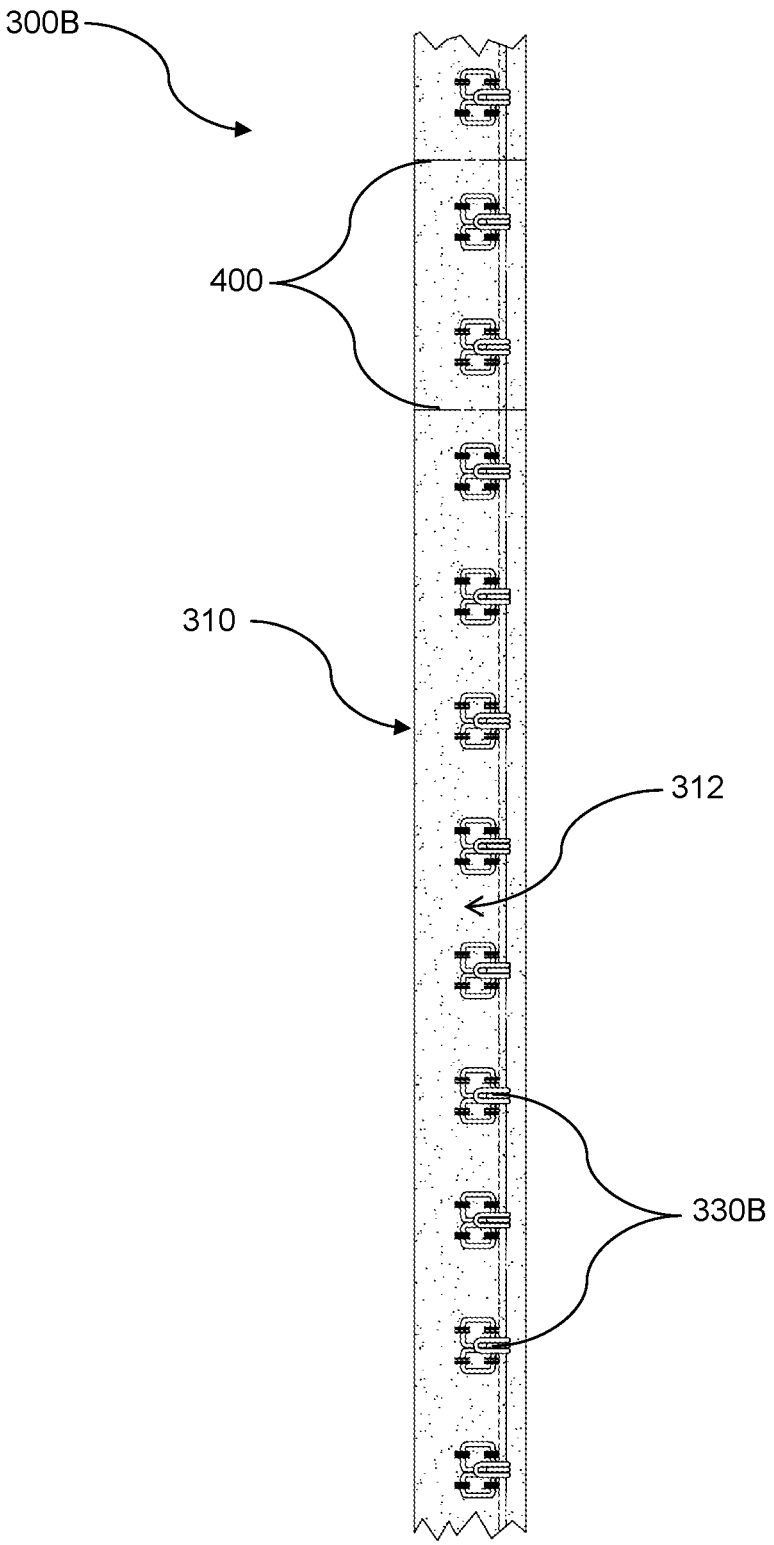
FIG. 4B is an illustration of a top view of the continuous male batch for apportioning into discrete male adherent fastening products, in accordance with embodiments of the present disclosure.

In some embodiments, the continuous batch 300 of adherent fastening products 100 is supplied, such as to manufacturers of garments, in uncut form. The continuous batch 300 may also be referred to as a continuous composite tape. In some other embodiments and more preferably, the adherent fastening products 100 are supplied in pre-cut form. Accordingly, the method 200 may include an optional apportioning stage 220 of apportioning the continuous batch 300 of adherent fastening products 100 to form discrete adherent fastening products 100. With reference to FIG. 4A and FIG. 4B, the continuous batch 300 may be apportioned by cutting out the discrete adherent fastening products 100 along cutting lines 400. The adherent fastening products 100 may be cut out to suitable dimensions which may be dependent on the end applications of the adherent fastening products 100 and the garments. The adherent fastening products 100 may be cut out along the cutting lines using any suitable cutting mechanism or machine.

Each adherent fastening product 100 can be used for a garment, such as for fastening and coupling (or conversely unfastening and decoupling) opposing sides of the garment. Each adherent fastening product 100 includes a portion of the substrate 310, i.e. the substrate portion 110 having a first side 112 and a reverse second side 114. Each adherent fastening product 100 further includes a portion of the adhesive layer 320, i.e. the adhesive layer portion 120 disposed on the first side 112 and/or second side 114 of the substrate portion 110. Each adherent fastening product 100 further includes an array of the fasteners 330, i.e. the array of fasteners 130 attached to the first side 112 of the substrate portion 110.

For each adherent fastening product 100, the adhesive layer portion 120 is activatable to the active state that enables adhesion of the adherent fastening product 100 to the respective garment. The method 200 may include a step of adhering or bonding the respective adherent fastening product 100 to the respective garment. The adhesive layer portion 120 may be partially cured so that it has some or limited adherence which would be useful for aligning and lightly adhering the adherent fastening product 100 to the garment.

In one embodiment, the adhesive layer portion 120 is disposed on the second side 114 of the substrate portion 110. The adherent fastening product 100 is bonded to the garment by the second side 114 on a fabric layer of the garment, thus exposing the first side 112 and the fasteners 130. In another embodiment, the adhesive layer portion 120 is disposed on the first side 112 of the substrate portion 110. The adherent fastening product 100 is bonded to the garment by the first side 112 on a fabric layer of the garment, thus covering the first side 112 by the fabric layer. In yet another embodiment, the adhesive layer portion 120 is disposed on both the first side 112 and second side 114 of the substrate portion 110. The adherent fastening product 100 is bonded to the garment by interposing or sandwiching the adherent fastening product 100 between two fabric layers of the garment, such that both the first side 112 and second side 114 are bonded to the respective fabric layers. The first side 112 is similarly covered by the respective fabric layer. Additionally, the fabric layer covering the first side 112 has holes such that the fasteners 130, which are attached other first side 112, are exposed through the holes in said fabric layer. This advantageously allows the adherent fastening product 100 to be hidden or obscured by the fabric layers of the garment while exposing the fasteners 130 for fastening and unfastening of the garment. This presents a more aesthetically pleasing appearance of the garment when used with the adherent fastening product 100.

The method 200 may further include an activation stage having a step of activating the adhesive layer portion 120 from the inactive state to the active state that enables adhesion of the respective adherent fastening product 100 to the respective garment. In one embodiment, said activating includes subjecting the adhesive layer portion 120 to heating under various conditions including temperature, pressure, and duration. In another embodiment, said activating includes triggering a chemical reaction in the adhesive layer portion 120, such as by adding another substance to the adhesive layer portion 120. The activation stage further includes a step of completely curing, e.g. by heating, the adhesive layer portion 120 in the active state for permanently adhering the respective adherent fastening product 100 to the respective garment.

As described in various embodiments herein, the adherent fastening product 100 has an adhesive layer portion 120 that is initially in the inactive state to support handling. The adhesive layer portion 120 can then be activated to the active state for permanently adhering the adherent fastening product 100 to the garment. The adhesive layer portion 120 thus functions as a pre-applied glue film or web lining that obviates the need for the conventional time-consuming operation of coating or lining garment fastening products, such as the hook-and-eye tapes, during manufacturing of the garment. The adhesive layer portion 120 is activated and cured only during the final stages of the garment manufacturing process instead of during manufacturing of the adherent fastening product 100. Specifically, the adhesive layer portion 120 is activated only after the garment is nearly completely formed and the adherent fastening product 100 is positioned at the appropriate location on the garment where the adherent fastening product 100 is to be permanently adhered or bonded.

In the foregoing detailed description, embodiments of the present disclosure in relation to an adherent fastening product 100 and a method 200 of manufacturing the adherent fastening products 100 are described with reference to the provided figures. The description of the various embodiments herein is not intended to call out or be limited only to specific or particular representations of the present disclosure, but merely to illustrate non-limiting examples of the present disclosure. The present disclosure serves to address at least one of the mentioned problems and issues associated with the prior art. Although only some embodiments of the present disclosure are disclosed herein, it will be apparent to a person having ordinary skill in the art in view of this disclosure that a variety of changes and/or modifications can be made to the disclosed embodiments without departing from the scope of the present disclosure. Therefore, the scope of the disclosure as well as the scope of the following claims is not limited to embodiments described herein.

The invention claimed is:

1. An adherent fastening product for a garment, comprising:

a substrate portion having a first side and a reverse second side;

an adhesive layer portion disposed evenly on the first side of the substrate portion and optionally disposed evenly on the second side of the substrate portion;

the adhesive layer portion having an inner side and an outer side, the inner side adhesively attached to the substrate portion and the outer side adhesively attachable to the garment; and an array of fasteners attached to the first side of the substrate portion and through the adhesive layer portion, wherein the adhesive layer portion is in an inactive state that inhibits adhesion of the outer side of the adhesive layer portion to the garment; and wherein the adhesive layer portion is activatable to an active state that enables adhesion of the outer side of the adhesive layer portion to the garment, thereby adhering the adherent fastening product to the garment via the adhesive layer portion.

2. The product according to claim 1, wherein the adhesive layer portion in the inactive state is in a film or web lining form.

3. The product according to claim 1, wherein the adhesive layer portion in the inactive state comprises a liquid glue substance in dry liquid form.

4. The product according to claim 3, wherein the liquid glue substance is uncured or partially cured.

5. The product according to claim 1, wherein the adhesive layer portion comprises:

a discrete first adhesive layer portion disposed evenly on the first side of the substrate portion, the inner side of the first adhesive layer portion adhesively attached to the first side of the substrate portion; and a discrete second adhesive layer portion disposed evenly on the second side of the substrate portion, the inner side of the second adhesive layer portion adhesively attached to the second side of the substrate portion.

6. The product according to claim 1, wherein the adhesive layer portion is disposed continuously around the substrate portion and evenly on the first and second sides thereof.

7. The product according to claim 1, wherein the fasteners are stitched to the first side of the substrate portion.

8. The product according to claim 1, wherein the substrate portion is formed from a fabric material.

9. A method of manufacturing adherent fastening products for garments, the method comprising:

forming a continuous batch of adherent fastening products, comprising:

forming a substrate having a first side and a reverse second side;

disposing an adhesive layer evenly on the first side of the substrate and optionally evenly on the second side of the substrate, the adhesive layer having an inner side and an outer side, the inner side adhesively attached to the substrate and the outer side adhesively attachable to the garment; and attaching fasteners to the first side of the substrate and through the adhesive layer, wherein the adhesive layer is in an inactive state that inhibits adhesion of the outer side of the adhesive layer to the garments; and wherein the adhesive layer is activatable to an active state that enables adhesion of the outer side of the adhesive layer to the garments, thereby adhering the adherent fastening products to the garments via the adhesive layer.

10. The method according to claim 9, further comprising apportioning the continuous batch of adherent fastening products to form discrete adherent fastening products, each adherent fastening product for a garment and comprising:

a portion of the substrate having the first side and the reverse second side;

a portion of the adhesive layer disposed evenly on the first side and optionally evenly on the second side of the substrate portion, the inner side of the adhesive layer portion adhesively attached to the substrate portion and the outer side of the adhesive portion adhesively attachable to the garment; and an array of the fasteners attached to the first side of the substrate portion and through the adhesive layer, wherein for each adherent fastening product, the adhesive layer portion is in an inactive state that inhibits adhesion of the outer side of the adhesive layer portion to the garment; and wherein for each adherent fastening product, the adhesive layer portion is activatable to the active state that enables adhesion of the outer side of the adhesive layer portion to the garment, thereby adhering the adherent fastening product to the garment via the adhesive layer.

11. The method according to claim 10, further comprising activating the adhesive layer portion to the active state that enables adhesion of the outer side of the adhesive layer portion, thereby adhering the respective adherent fastening product to the respective garment via the adhesive layer portion.

12. The method according to claim 11, further comprising completely curing the adhesive layer portion in the active state for permanently adhering the respective adherent fastening product to the respective garment.

13. The method according to claim 9, wherein the adhesive layer in the inactive state is in a film or web lining form.

14. The method according to claim 9, wherein said disposing of the adhesive layer comprises applying a liquid glue substance in dry liquid form evenly on the first side and optionally evenly on the second side of the substrate.

15. The method according to claim 14, wherein said disposing of the adhesive layer further comprises partially curing the liquid glue substance.

16. The method according to claim 9, wherein said disposing of the adhesive layer comprises:

disposing a discrete first adhesive layer evenly on the first side of the substrate and adhesively attaching the inner side of the first adhesive layer to the first side of the substrate; and disposing a discrete second adhesive layer evenly on the second side of the substrate and adhesively attaching the inner side of the second adhesive layer to the second side of the substrate.

17. The method according to claim 9, wherein said disposing of the adhesive layer comprises disposing the adhesive layer continuously around the substrate and evenly on the first and second sides thereof.

18. The method according to claim 9, wherein said attaching of the fasteners comprises stitching the fasteners to the first side of the substrate.

* * * * *